US007451746B2

(12) United States Patent
Bellmore

(10) Patent No.: US 7,451,746 B2
(45) Date of Patent: Nov. 18, 2008

(54) CANISTER ASSEMBLY

(76) Inventor: Daniel J. Bellmore, 15355 Upton Rd., East Lansing, MI (US) 48823

( * ) Notice: Subject to any disclaimer, the term of this patent is extended or adjusted under 35 U.S.C. 154(b) by 118 days.

(21) Appl. No.: 11/315,503

(22) Filed: Dec. 23, 2005

(65) Prior Publication Data

US 2007/0144496 A1 Jun. 28, 2007

(51) Int. Cl.
*F02M 33/02* (2006.01)

(52) U.S. Cl. ..... 123/519; 123/516; 96/135

(58) Field of Classification Search ..... 123/516, 123/518, 519, 520; 96/135, 136
See application file for complete search history.

(56) References Cited

U.S. PATENT DOCUMENTS

| | | | | |
|---|---|---|---|---|
| 4,279,233 | A | 7/1981 | Tobita et al. | |
| 4,386,947 | A | 6/1983 | Mizuno et al. | |
| 4,507,132 | A * | 3/1985 | Yoshida | 96/139 |
| 4,655,189 | A * | 4/1987 | Koga | 96/136 |
| 4,869,739 | A | 9/1989 | Kanome et al. | |
| 4,951,643 | A | 8/1990 | Sato et al. | |
| 5,253,629 | A * | 10/1993 | Fornuto et al. | 123/519 |
| 5,393,329 | A | 2/1995 | Inagaki et al. | |
| 5,453,118 | A | 9/1995 | Heiligman | |
| 5,641,344 | A * | 6/1997 | Takahashi et al. | 96/139 |
| 5,861,050 | A * | 1/1999 | Pittel et al. | 95/115 |
| 5,878,729 | A * | 3/1999 | Covert et al. | 123/520 |
| 5,910,637 | A * | 6/1999 | Meiller et al. | 96/135 |
| 5,915,364 | A | 6/1999 | Katou et al. | |
| 6,390,073 | B1 * | 5/2002 | Meiller et al. | 123/519 |
| 6,425,380 | B2 * | 7/2002 | Yamada et al. | 123/519 |
| 7,114,492 | B2 * | 10/2006 | Reddy | 123/518 |
| 2005/0045160 | A1 * | 3/2005 | Peterson et al. | 123/519 |

* cited by examiner

*Primary Examiner*—Carl S Miller
(74) *Attorney, Agent, or Firm*—Walter Ottesen

(57) ABSTRACT

A canister assembly is mounted between a fuel tank and an internal combustion engine. The canister assembly includes a canister holding a carbon charge for adsorbing fuel vapors emanating from the fuel tank. A trap box defines a plenum and is mounted on the canister and a canister pipe stub permits the plenum to communicate with the carbon charge. The trap box has a load port disposed thereon and the load port is connectable to the fuel tank for passing a flow of fuel vapors from the tank into the plenum with the fuel vapors becoming adsorbed by the carbon charge as the vapors flow from the plenum and through the canister pipe stub and into the carbon charge in response to an overpressure in the fuel tank. The canister pipe stub is arranged in the plenum so as to permit any liquid fuel accompanying the vapor flow to become trapped in the plenum thereby preventing the liquid fuel from reaching the carbon charge and causing the latter to become degraded thereby.

6 Claims, 9 Drawing Sheets

CANISTER ASSEMBLY

FIELD OF THE INVENTION

The invention relates to a canister assembly for vapor recovery and especially to an on-board canister assembly for liquid fuel and vapor recovery.

BACKGROUND OF THE INVENTION

During refueling of a vehicle, fuel vapor is displaced from the fuel tank by the entering fuel. To prevent the displaced fuel vapors from entering the atmosphere, they are adsorbed in a canister containing a carbon charge. The canister is fluidly connected to the fuel tank and receives the fuel vapors as they are displaced. The carbon charge is an adsorbent material which adsorbs the fuel vapors.

After the fueling operation, the adsorbent loaded with fuel vapor can be desorbed as vapor in a purge cycle and is drawn by suction to the engine during an intake cycle where it is recovered for combustion. Motorists sometimes fill their tank to excess by "topping off" the fuel tank. This can cause liquid fuel to be sent to the canister where, if it enters the canister, it causes the carbon charge performance to be degraded so that vapors can no longer be adsorbed.

SUMMARY OF THE INVENTION

In view of the above, it is an object of the invention to provide a canister assembly incorporating a trap box for trapping liquid fuel thereby preventing the same from entering the canister and causing the carbon charge to become degraded. It is another object of the invention to provide a canister assembly with a liquid trap which enables an original canister design to be retained thereby minimizing an investment in tooling.

It is still another object of the invention to provide a trap box which can be mounted on commercially available canisters without modification of the latter.

The canister assembly of the invention is interposed between a fuel tank and the internal combustion engine. The canister assembly includes: a canister having a housing having a wall defining an interior space for accommodating a carbon charge for adsorbing fuel vapors emanating from the fuel tank; a first port mounted in the wall for connecting the interior space to the ambient; a second port communicating with the interior space; a trap box defining a plenum and being mounted on the wall so as to contain the second port therein permitting the plenum to communicate with the interior space via the second port; the trap box having a load port mounted thereon and the load port being connectable to the fuel tank for passing a flow of fuel vapors from the tank into the plenum with the fuel vapors becoming adsorbed by the carbon charge as the vapors flow from the plenum and through the second port and into the carbon charge in response to an overpressure in the fuel tank; the second port being configured and arranged in the plenum so as to permit any liquid fuel accompanying the flow to become trapped in the plenum thereby preventing the liquid fuel from reaching the carbon charge and causing the latter to become degraded; and, a purge port communicating with the carbon charge and being connectable to the engine so as to permit the fuel vapor adsorbed by the carbon charge to be drawn into the engine in response to an underpressure during the operation thereof thereby purging the carbon charge to regenerate the same.

Another advantage of the canister assembly of the invention is that the canister assembly can be tilted relative to a vertical axis to allow any liquid fuel trapped in the plenum of the liquid trap box to flow within the plenum without the liquid fuel pouring over an upper edge of the canister pipe stub which interconnects the plenum of the liquid trap box and the interior of the canister holding the carbon charge.

With the liquid fuel trap of the invention, an original canister design can be utilized unchanged thereby minimizing any investment in tooling. The liquid trap is essentially self-contained and can be mounted on many commercially available canisters externally and can be adjusted as to volume and function pursuant to customer requirements.

Still another advantage of the invention is that the external trap does not reduce the volume of the carbon charge nor require an additional welding station during assembly. The external liquid trap may be altered for volume, number of ports and port direction at minimal cost to accommodate the canister configuration.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
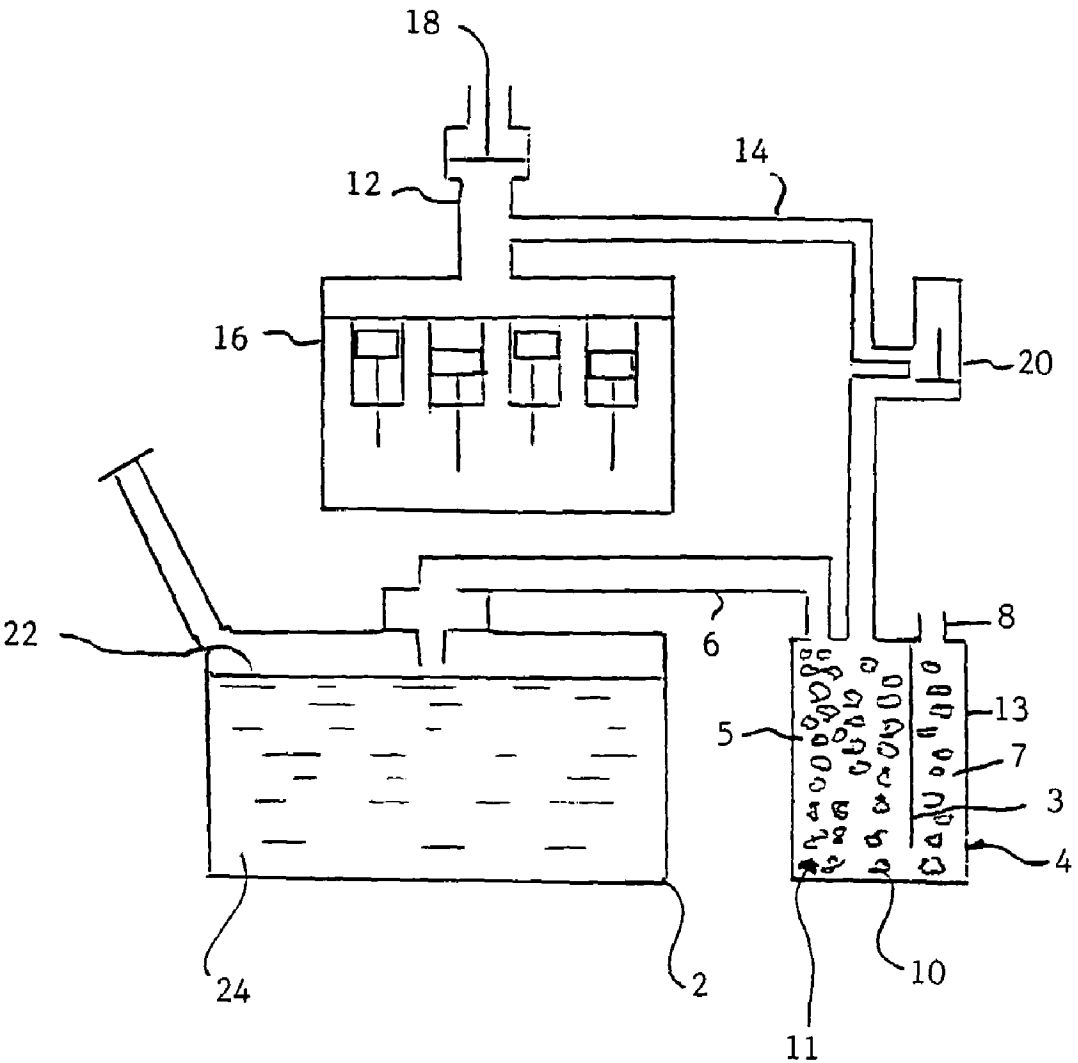
FIG. 1 shows a typical fuel and evaporative emissions system for an internal combustion engine wherein the canister does not include a liquid trap box.

Referring to FIG. 1, a fuel tank 2 is connected to a canister 4 via a connecting line 6. The canister 4 has an outlet 8 which vents via a filter (not shown) to the atmosphere. The particles 10 represent the carbon charge 11 contained in the canister 4. The canister 4 has a housing 13 and is connected to the intake manifold 12 of the engine via a purge line 14. Reference numeral 16 identifies the engine to which an air/fuel mixture is passed via the throttle 18. A purge valve 20 is activated during operation of the engine so that the fuel vapors adsorbed by the carbon charge 11 are drawn into the engine for combustion during a purge cycle while the purge valve is in the open position. The canister housing 13 includes an interior wall 3 which divides the interior into first and second chambers (5, 7).

As the tank is filled, the fuel level 22 of the fuel 24 causes fuel vapors to be pushed into the canister where they are adsorbed by the carbon charge 11. The vapor entering the canister passes downwardly through the first chamber 5 and then into the second chamber 7.

FIG. 1 shows a normal fill of the fuel tank and all units functioning properly allowing venting of fuel vapor into the canister 4.

Figure 2:
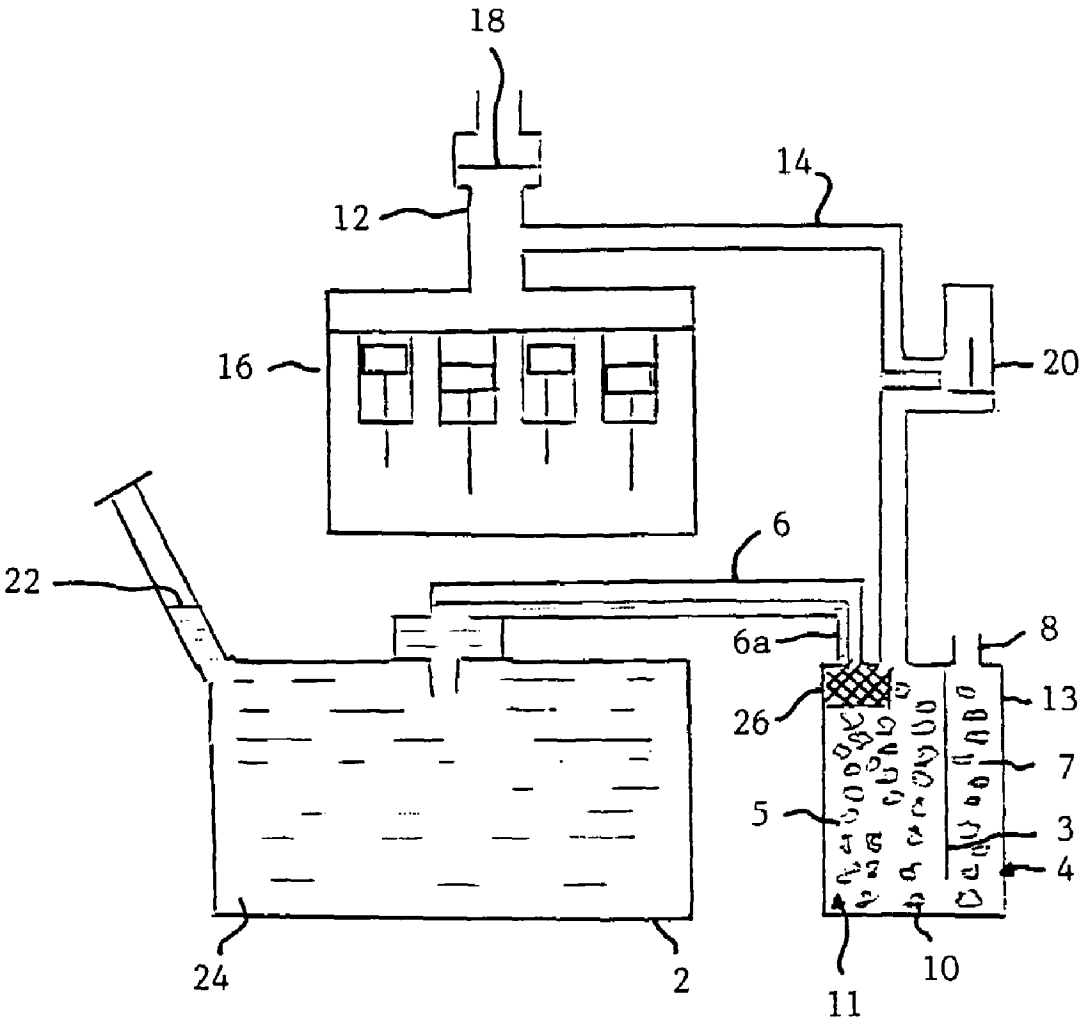
FIG. 2 is a schematic showing a fuel and evaporative emissions system wherein no liquid fuel trap is provided and there is an overfill condition.

In FIG. 2, an overfill situation is shown and liquid fuel has risen above the tank 2 and passes through the connecting line 6 and trickles down segment 6*a* thereof into the canister 4, where it enters the carbon charge 11 degrading the ability of the carbons to adsorb and desorb effectively.

Figure 3:
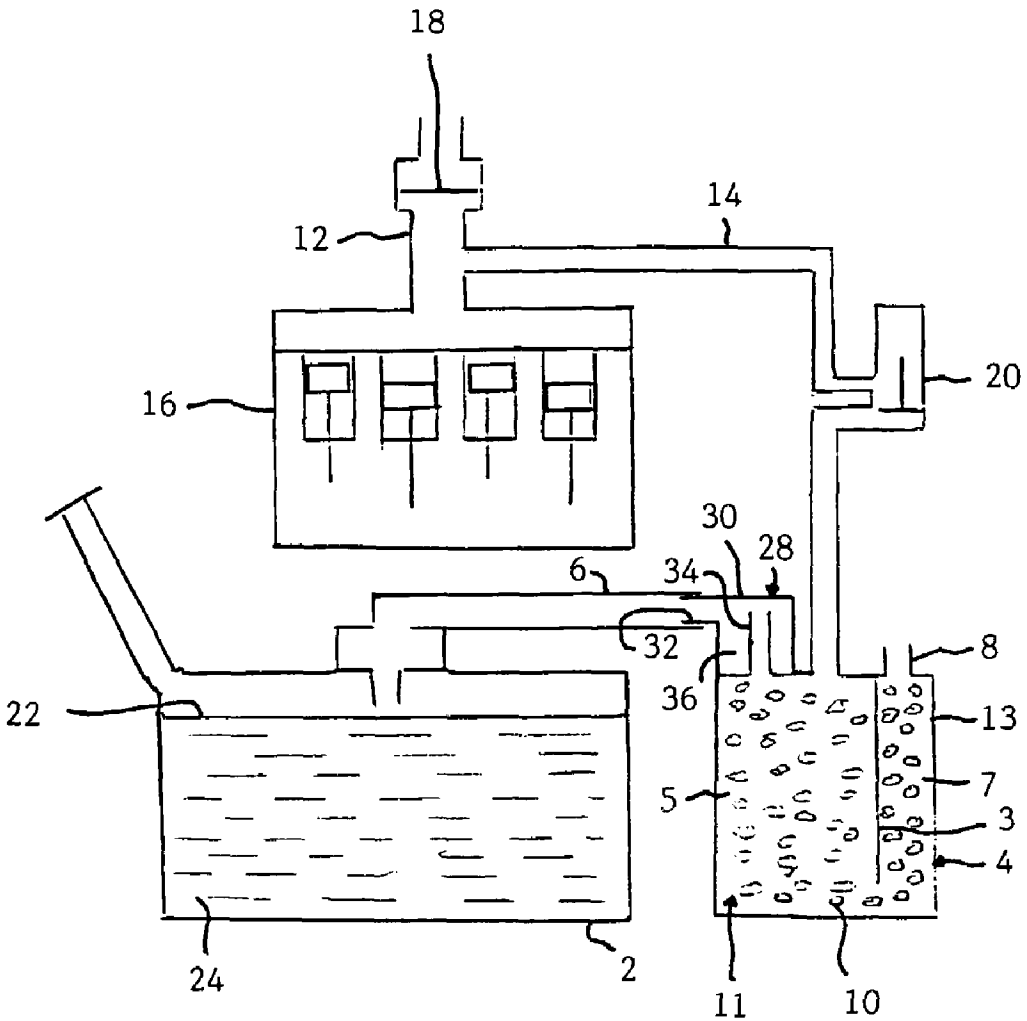
FIG. 3 is a schematic of a fuel and evaporative emissions system equipped with a canister assembly according to the invention with a normal fill of the fuel tank.

FIG. 3 shows a simplified schematic of a canister 4 equipped with a liquid trap 28 to thereby form the canister assembly according to the invention. The liquid trap 28 has a housing 30 with an inlet pipe stub 32. An anti-splash pipe stub 34 extends upwardly from the top wall of the canister 4 and into the interior space 36 of the liquid trap 28. The system of FIG. 3 operates in the same manner as that shown in FIG. 1 when the fuel level 22 corresponds to the normal fill shown. In FIG. 3, all units function properly allowing venting into the canister 4.

Figure 4:
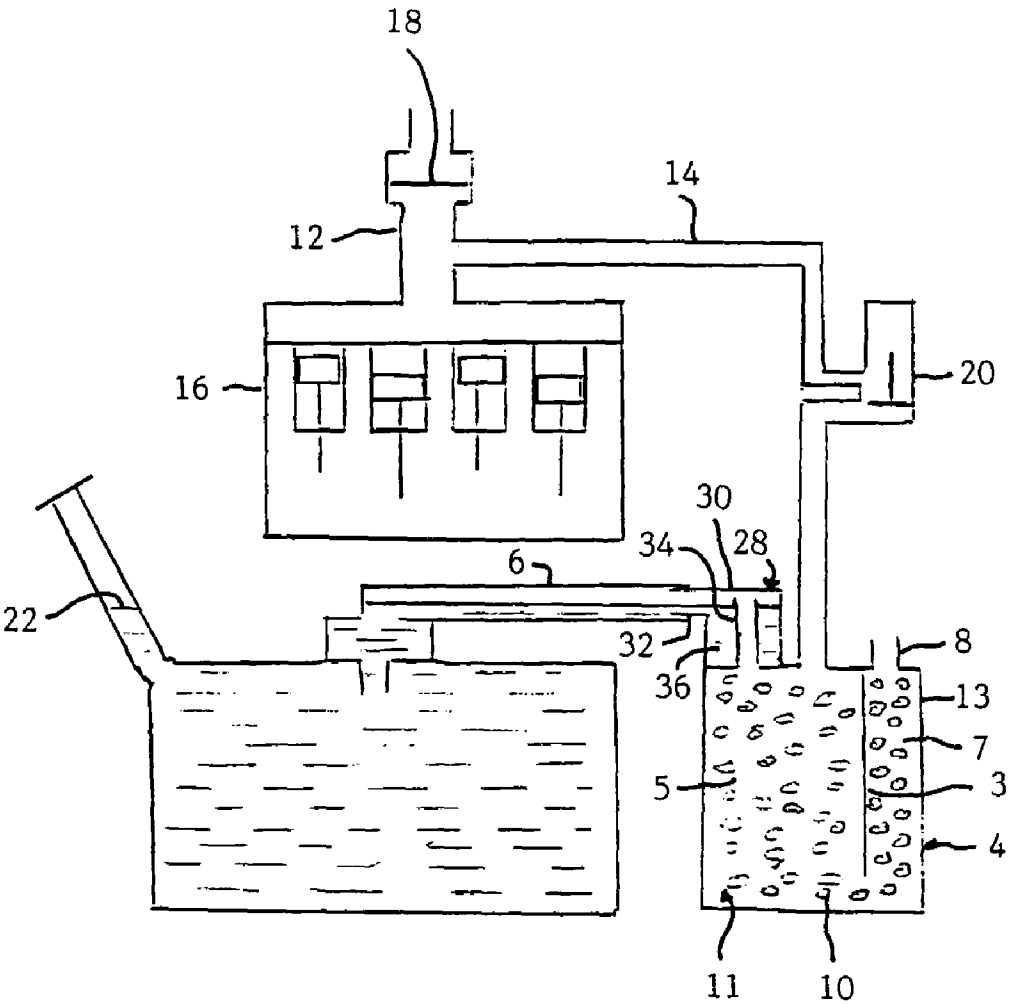
FIG. 4 is a schematic of a fuel and evaporative emissions system corresponding to the embodiment shown in FIG. 3 but with an overfill condition.

FIG. 4 shows the fuel and evaporative emissions system equipped with a canister assembly according to the invention wherein an overfill is present. With the overfill, liquid fuel rises to fuel level 22 shown and passes through the connecting line 6 to the liquid trap 28 where the liquid fuel also rises in the interior space or plenum 36 as shown. It can be seen that the anti-splash pipe stub 34 prevents liquid fuel from entering the canister 4 and reaching the carbon charge 11 of the canister 4. Accordingly, carbon function is maintained because liquid fuel is kept from entering the canister 4. Thus, in FIG. 4, all units function properly allowing venting through the canister.

Figure 5:
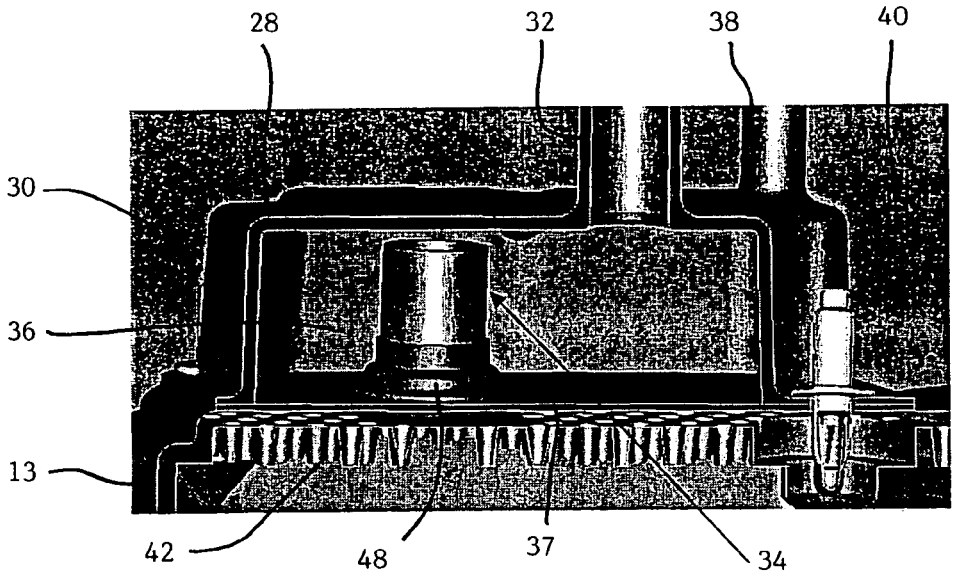
FIG. 5 is a perspective detail view of the liquid fuel trap mounted atop the canister with a portion of the liquid fuel trap housing cut away to show the interior or plenum thereof.

Referring to FIG. 5, the canister assembly is shown in a perspective view with the liquid trap 28 mounted atop the canister. The outlet 8 vents to the atmosphere via a filter (not shown). The liquid trap 28 is preferably made of nylon which is resistant to liquid permeation when subjected to liquid fuel.

In a preferred embodiment of the invention, both the purge pipe stub 38 and the inlet pipe stub 32 for connecting to the fuel tank are mounted on the roof of the liquid fuel trap housing 30 and communicate with the interior space 36 thereof. Fuel vapor enters the connecting line 6 and passes through inlet pipe stub 32 into the interior space 36 of the liquid fuel trap housing 30 whereafter the fuel vapor passes via anti-splash pipe stub 34 into the canister housing 13 where it is adsorbed by the activated carbon. The plurality of projections 42, which extend from the top wall of the canister housing 13 in the first chamber, function to evenly distribute fuel vapor and purge air through the activated charcoal and facilitate the passage of the fuel vapor into and out of the activated charcoal. The second chamber 7 (not shown in FIG. 5) also includes these projections. A purge pipe stub 38 is connected to the purge line 14 shown in the schematics of FIGS. 1 to 4 and is used during a purge cycle. In the purge cycle, air is passed through the canister 4 to desorb the fuel vapor adsorbed by the activated carbon.

Figure 6:
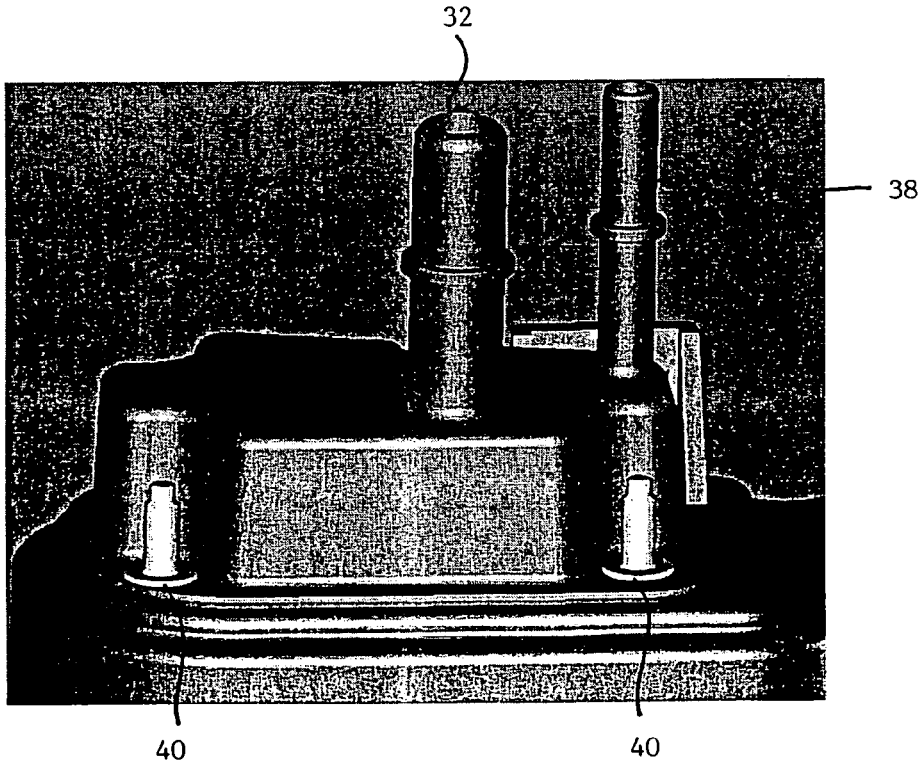
FIG. 6 is a perspective view of the liquid fuel trap mounted in position atop the canister.

FIG. 6 is a perspective view of the liquid trap 28 mounted atop the canister housing 13. Inlet pipe stub 32 and purge pipe stub 38 are attached to the roof wall or top of the liquid trap housing 30. The liquid trap housing 30 is kept in place on the canister housing 13 via studs 40.

In the embodiment shown, the anti-splash pipe stub 34 is a canister pipe stub and physically attached to the top wall of the canister housing 13 and is part of the canister 4 and communicates with the interior thereof. Fuel vapors, which enter the interior space or plenum 36 of the liquid trap 28, pass through the anti-splash pipe stub 34 into the carbon charge (not shown in FIG. 6).

Figure 7:
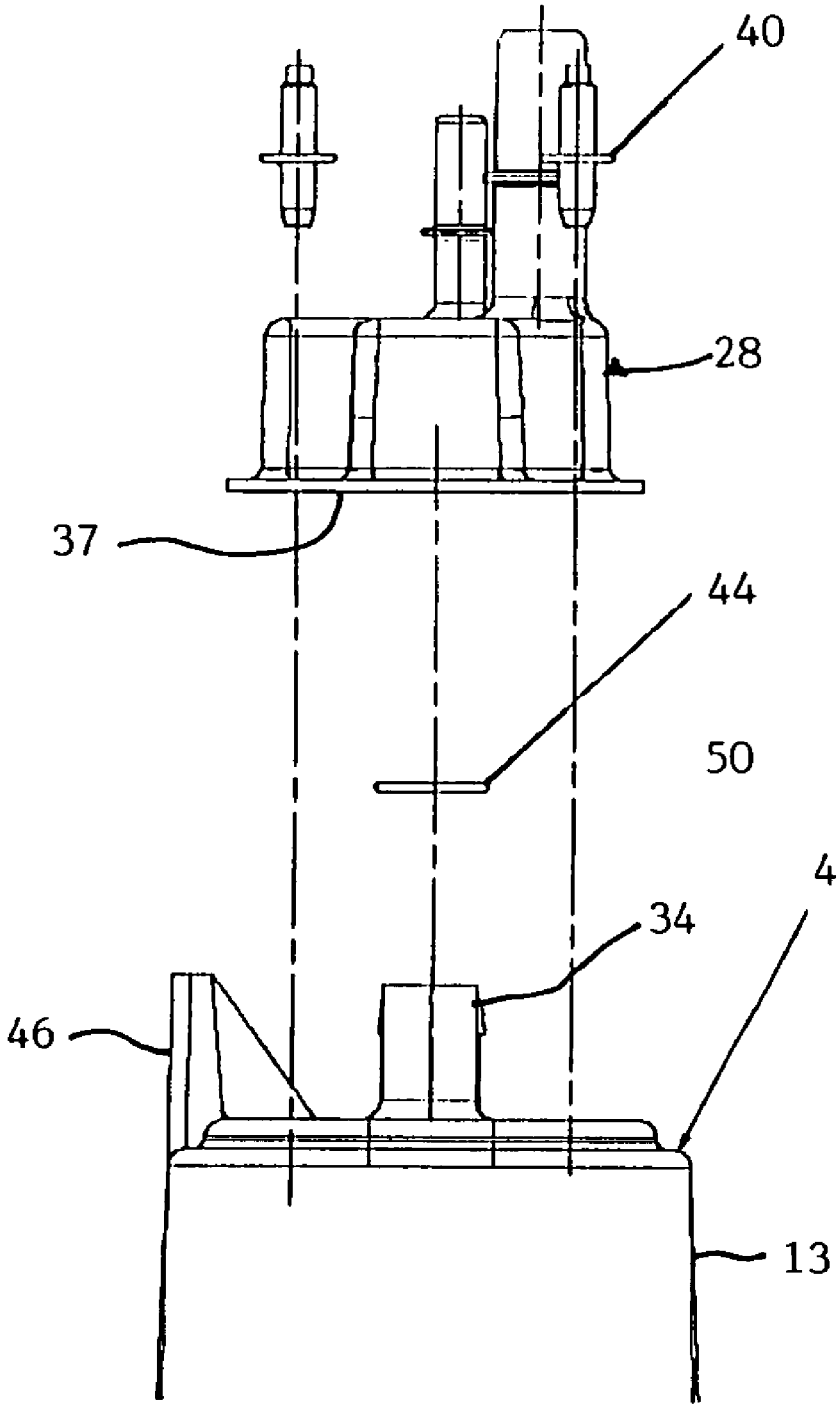
FIG. 7 is an exploded view showing the liquid fuel trap preparatory to mounting atop the canister.

Referring to FIG. 7, it can be seen that the liquid trap 28 is a part separate from the canister 4 and is pushed into place onto the canister 4 having a handle 46. The liquid trap 28 has a base wall incorporating a flanged collar 48 (see FIG. 5) which slips over the anti-splash pipe stub 34 when the liquid trap is pushed down upon the canister 4. An O-ring 44 provides for a seal-tight connection between the flanged collar 48 of the base wall 37 of the liquid trap 28 and the anti-splash pipe stub 34. The anti-splash pipe stub 34 prevents any potential fuel from going into the carbon charge during the load cycle when the fuel tank 2 (see FIG. 4) is filled with fuel and is also a guide for placing the liquid trap box in its exact position on the canister housing 13. The anti-splash pipe stub 34 thereby performs a dual function. When assembled, the base wall 37 of the liquid trap is directly adjacent the top wall 50 of the housing 13 of the canister 4.

Figure 8:
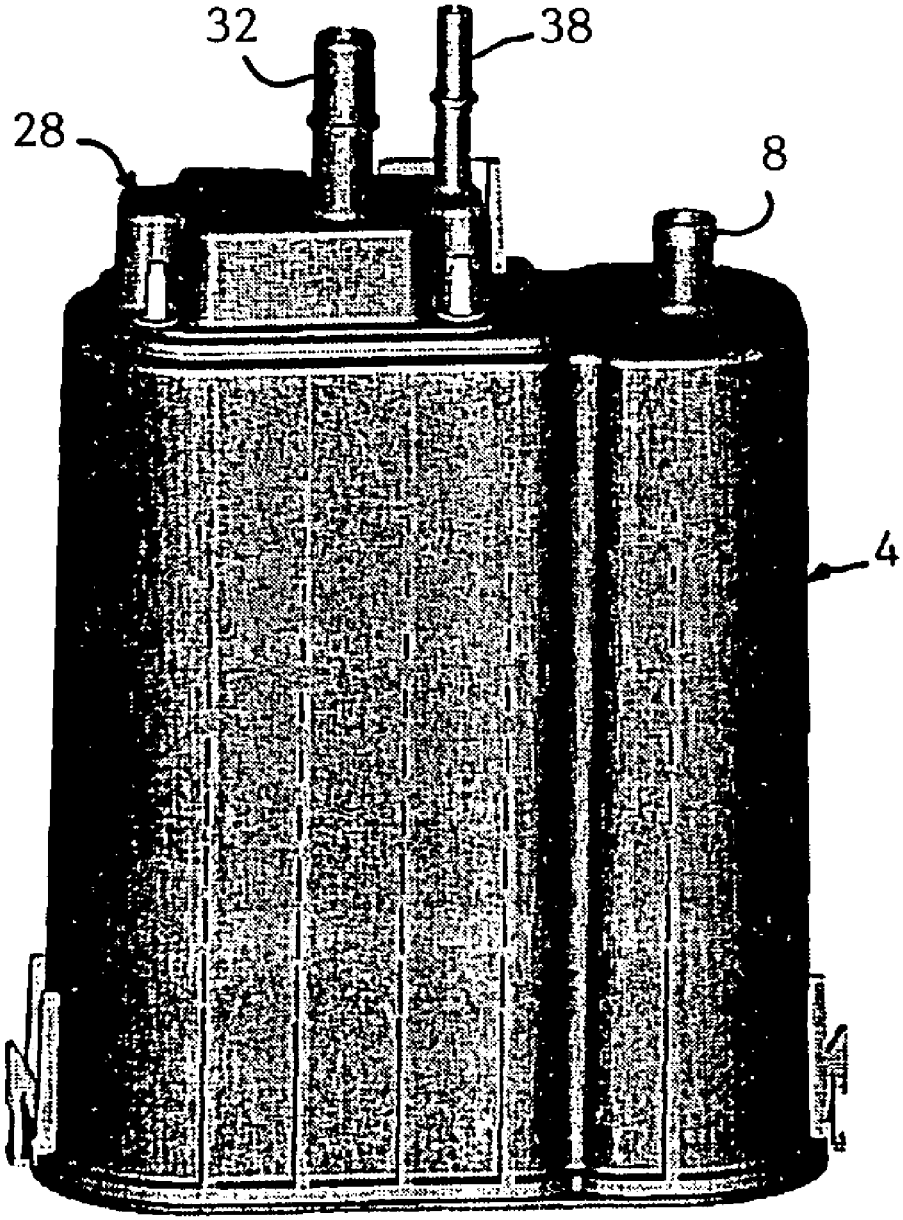
FIG. 8 is a perspective view of the canister assembly of the invention with the liquid fuel trap mounted atop the canister.

A significant advantage of the canister assembly of the invention is that it allows for a very substantial degree of freedom for mounting the same. Thus, it is not necessary to mount the canister assembly with the liquid trap shown as in FIG. 8 wherein the liquid trap is positioned so that its base wall is horizontal.

Figure 9A:
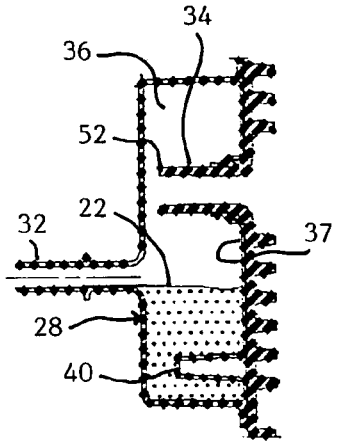
FIGS. 9*a* to 9*i* show a sequence of views, in section, of the liquid fuel trap at various angles relative to the horizontal.
Figure 9B:
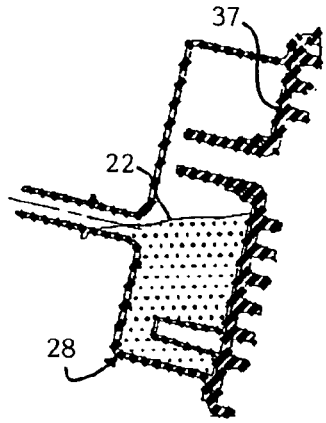
Figure 9C:
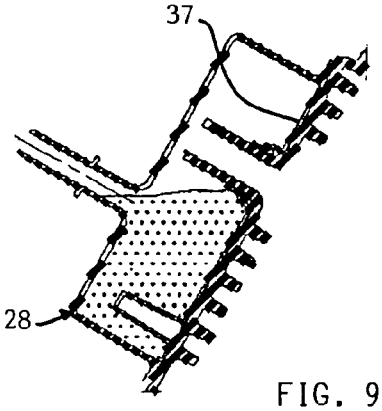
Figure 9D:
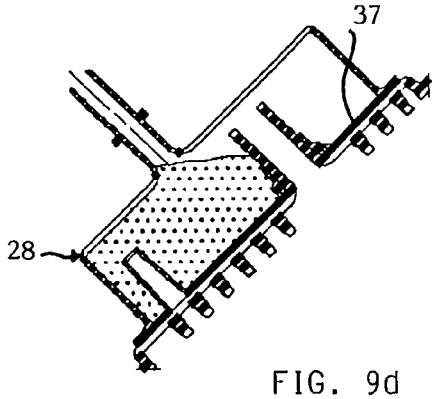
Figure 9E:
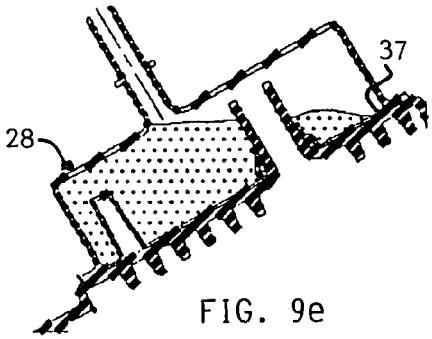
Figure 9F:
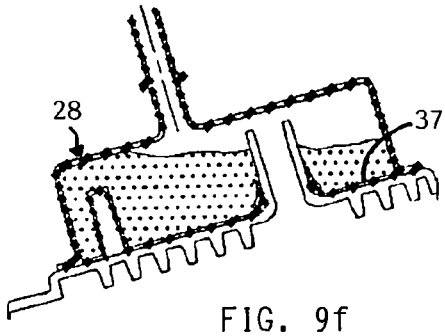
Figure 9G:
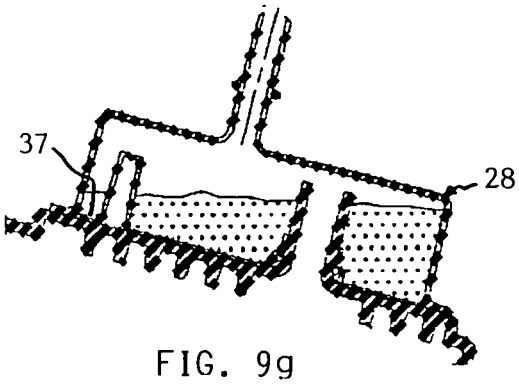
Figure 9H:
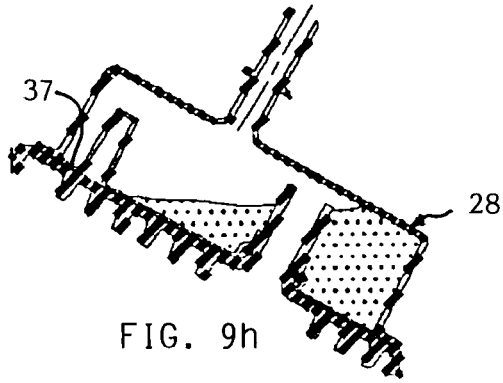
Figure 9I:
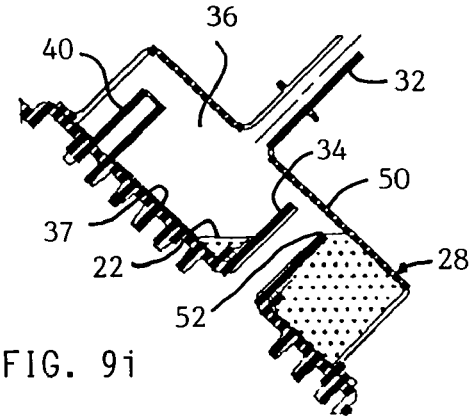

FIGS. 9*a* to 9*i* show the liquid trap in various positions as the canister assembly is tilted. Thus, in FIG. 9*a*, the base wall 37 of the canister at 90° with respect to the horizontal is shown. As shown in FIG. 9*a*, the fill level 22 of the liquid fuel in the liquid trap plenum cannot trickle or pour over the edge 52 of the anti-splash pipe stub 34 to disable the carbon charge. FIG. 9*b* shows the base wall 37 at 75° forward and FIG. 9*c* shows the base wall 37 at 60° forward. FIGS. 9*d* to 9*f* show the base wall 37 at 45°, 30° and 15° forward. FIGS. 9*g* to 9*i* show the base wall 37 tilted rearward at 15°, 30° and 45°, respectively. Thus, in each of the FIGS. 9*a* to 9*i*, the liquid fuel in the liquid trap plenum or interior space 36 cannot spill over the edge 52 of the anti-splash pipe stub 34.

Figure 10A:
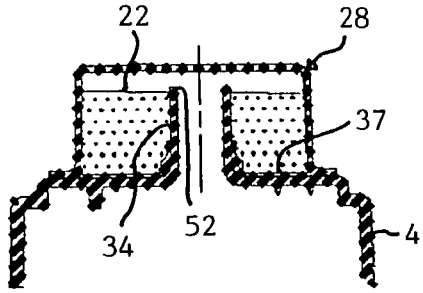
FIG. 10*a* is a section view taken at 90° with respect to the section shown in FIGS. 9*a* to 9*i* with the base wall in a horizontal position; and, FIGS. 10*b* and 10*c* show the liquid fuel trap at 45° forward and rearward, respectively, to the horizontal.
Figure 10B:
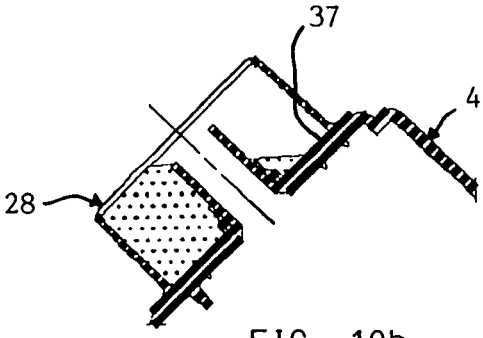
Figure 10C:
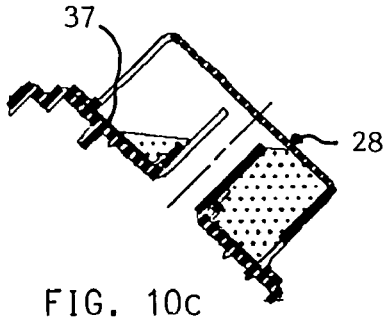

FIGS. 10*a* to 10*c* show a cross section of the liquid trap at 90° with respect to the views shown in FIGS. 9*a* to 9*i*. In FIG. 10*a*, the base wall 37 is horizontal and in FIGS. 10*b* and 10*c* the base wall 37 is shown at 45° to the horizontal.

As shown above, the canister assembly of the invention affords considerable advantage when mounting the same in a motor vehicle. This permits the manufacturer of a motor vehicle to position the canister assembly of the invention in a position which maximizes the use of the limited space available for components mounted in the vehicle.

It is understood that the foregoing description is that of the preferred embodiments of the invention and that various changes and modifications may be made thereto without departing from the spirit and scope of the invention as defined in the appended claims.

What is claimed is:

1. A canister assembly interposed between a fuel tank and an internal combustion engine, the canister assembly comprising:

a canister having a housing having a wall defining an interior space for accommodating a carbon charge for adsorbing fuel vapors emanating from the fuel tank;

a first port mounted in said wall for connecting said interior space to the ambient;

a second port communicating with said interior space;

a trap box defining a plenum and being mounted on said wall so as to contain said second port therein permitting said plenum to communicate with said interior space via said second port;

said trap box having a load port mounted thereon and said load port being connectable to said fuel tank for passing a flow of fuel vapors from said tank into said plenum with said fuel vapors becoming adsorbed by said carbon charge as said vapors flow from said plenum and through said second port and into said carbon charge in response to an overpressure in said fuel tank;

said second port being configured and arranged in said plenum so as to permit any liquid fuel accompanying said flow to become trapped in said plenum thereby preventing said liquid fuel from reaching said carbon charge and causing the latter to become a plug to said vapors;

a purge port communicating with said carbon charge and being connectable to said engine so as to permit the fuel vapor adsorbed by said carbon charge to be drawn into said engine in response to an underpressure during the operation thereof thereby purging said carbon charge to regenerate the same;

said wall of said housing having an outer surface and said second port is a canister pipe stub extending upwardly from said outer surface; and, said trap box being mounted on said outer surface so as to contain said canister pipe stub in said plenum thereof;

said trap box having a roof wall and said canister pipe stub extending upwardly into said plenum so as to terminate in spaced relationship to said roof wall; and, said load port being a load pipe stub and said purge port being a purge pipe stub mounted on said trap box; and, said load pipe stub and said purge pipe stub each communicating with said plenum;

said canister pipe stub having an upper edge defining an inlet thereinto;

said canister pipe stub being disposed within said plenum so as to permit said canister assembly to be tilted relative to a vertical axis to allow any liquid fuel trapped in said plenum to flow within said plenum without said liquid fuel pouring over said upper edge of said canister pipe stub and flowing into said carbon charge;

said trap box having a base wall lying opposite said roof wall and said base wall having a flanged collar formed thereon for receiving said canister pipe stub therein; and, a seal being interposed between said flanged collar and said canister pipe stub for sealing said plenum with respect to said canister pipe stub.

2. The canister assembly of claim 1, wherein said canister pipe stub and said flanged collar function as a locator for the placement and positioning of said trap box on said canister housing.

3. The canister assembly of claim 1, wherein said trap box is made of nylon.

4. A trap box mountable on a canister defining an. interior space for accommodating a carbon charge for adsorbing fuel vapors emanating from a fuel tank, said canister having a canister pipe stub communicating with said interior space and said trap box when said trap box is mounted on said canister, said trap box comprising:

an enclosed housing defining a plenum and having a base wall;

said base wall defining an opening formed therein so as to permit said canister pipe stub to be inserted into said plenum when said trap box is mounted on said canister;

a load port on said housing for connecting said trap box to said fuel tank for passing a flow of fuel vapors into said plenum with said fuel vapors becoming adsorbed by said carbon charge as said fuel vapors flow from said plenum and through said canister pipe stub and into said carbon charge; and, said canister pipe stub being arranged in said plenum so as to permit any liquid fuel accompanying said flow of fuel vapors to become trapped in said plenum thereby preventing said liquid fuel from reaching said carbon charge and causing the latter to become degraded thereby.

5. The trap box of claim 4, wherein said canister has a wall defining an inner wall surface facing toward said carbon change; and, a plurality of projections extend downwardly from said inner wall surface for evenly distributing fuel vapor through said carbon charge thereby facilitating passage of the fuel vapor into and out of said carbon charge.

6. The canister assembly of claim 1, wherein said wall of said canister includes a top portion defining an inner wall surface facing toward said carbon charge; and, a plurality of projections extend downwardly from said inner wall surface for evenly distributing fuel vapor through said carbon charge thereby facilitating passage of the fuel vapor into and out of said carbon charge.

* * * * *